US009518457B2

(12) United States Patent
Gronning

(10) Patent No.: US 9,518,457 B2
(45) Date of Patent: Dec. 13, 2016

(54) DOWNHOLE TOOL FOR OPENING A TRAVELLING VALVE ASSEMBLY OF A RECIPROCATING DOWNHOLE PUMP

(71) Applicant: David Gronning, Edmonton (CA)

(72) Inventor: David Gronning, Edmonton (CA)

(73) Assignee: GLOBAL OIL AND GAA AUPPLIES INC., Beaumont, Alberta (CA)

( * ) Notice: Subject to any disclaimer, the term of this patent is extended or adjusted under 35 U.S.C. 154(b) by 245 days.

(21) Appl. No.: 14/515,983

(22) Filed: Oct. 16, 2014

(65) Prior Publication Data

US 2015/0107823 A1 Apr. 23, 2015

Related U.S. Application Data

(60) Provisional application No. 61/892,783, filed on Oct. 18, 2013.

(51) Int. Cl.

| | |
|---|---|
| ***E21B 43/12*** | (2006.01) |
| ***F04B 47/02*** | (2006.01) |
| *F04B 47/00* | (2006.01) |

(52) U.S. Cl.

CPC ..... *E21B 43/127* (2013.01); *F04B 47/02* (2013.01); *E21B 43/12* (2013.01); *E21B 43/126* (2013.01); *F04B 47/00* (2013.01)

(58) Field of Classification Search

CPC ..... E21B 43/127; E21B 43/12; E21B 43/126; F04B 47/00; F04B 47/02

USPC ..... 417/554, 444

See application file for complete search history.

(56) References Cited

U.S. PATENT DOCUMENTS

| | | | | |
|---|---|---|---|---|
| 3,244,112 | A | 4/1966 | Parkin | |
| 4,781,847 | A | 11/1988 | Madden | |
| 4,907,953 | A | 3/1990 | Hebert et al. | |
| 5,382,142 | A * | 1/1995 | Spears | E21B 43/127 137/515 |
| 5,533,876 | A | 7/1996 | Nelson, II | |
| 5,893,708 | A | 4/1999 | Nelson, II | |
| 7,051,813 | B2 | 5/2006 | Haynes et al. | |
| 9,151,145 | B2 * | 10/2015 | Scott | E21B 43/127 |
| 2006/0083646 | A1 | 4/2006 | Ford | |
| 2013/0025846 | A1 | 1/2013 | Scott | |

OTHER PUBLICATIONS

Dartt Valve. Dartt® Valve Co. Ltd., Flint, Texas, USA. http://www.darttsystems.com/valve.html (Date Unknown).

Sure Flow Valve. 2013. Dayzon Energy Solutions. www.dayzon.ca.

* cited by examiner

*Primary Examiner* — Jennifer H Gay

*Assistant Examiner* — George Gray

(74) *Attorney, Agent, or Firm* — Bennett-Jones LLP

(57) ABSTRACT

A downhole tool for opening a travelling valve assembly of a downhole pump is disposed with the travelling valve assembly within a pump barrel, and includes a substantially cylindrical housing and a piston. The housing defines an axial bore extending from a bottom opening for fluid communication with the pump barrel, a radial port for fluid communication between the axial bore and the pump barrel, and a channel formed in the outer surface of the housing for fluid communication between the radial port and the travelling valve assembly. The piston occludes the axial bore above the radial port, and in response to an upward pressure exerted by a production fluid below the piston, slides upwardly within the axial bore to engage and open a valve member of the travelling valve assembly.

20 Claims, 7 Drawing Sheets

DOWNHOLE TOOL FOR OPENING A TRAVELLING VALVE ASSEMBLY OF A RECIPROCATING DOWNHOLE PUMP

CROSS REFERENCE TO RELATED APPLICATION

This application claims the priority benefit of U.S. Provisional Patent Application No. 61/892,783, entitled "Downhole Valve Opening Tool" and filed on Oct. 18, 2013, the entire contents of which are incorporated herein by reference.

FIELD OF THE INVENTION

The present invention relates to a downhole tool for opening a travelling valve assembly of a reciprocating downhole pump.

BACKGROUND OF THE INVENTION

Reciprocating downhole pumps are used to elevate production fluids from a subterranean oil and gas well. Such pumps are typically driven by a motor, such as a pump jack, at the ground surface. A stationary standing valve is positioned at the bottom of a string of production tubing near the producing perforations of the well. A hollow cylindrical pump barrel is positioned above the standing valve and contains a traveling plunger with a traveling valve assembly. The plunger assembly is attached at its top end to a sucker rod which is actuated by the pump jack at the surface.

On the upstroke of the travelling plunger, the travelling valve assembly closes, so that each upstroke lifts a column of production fluid towards the surface. Meanwhile, the standing valve opens to charge the pump barrel below the travelling valve assembly with production fluid. On the downstroke of the travelling plunger, the travelling valve assembly opens to allow the production fluid to charge the pump barrel above the travelling valve assembly with a new column of production fluid for the next upstroke. Meanwhile, the standing valve closes to prevent the fluid drawn into the pump barrel below the plunger from flowing back into the production tubing.

The traveling valve assembly in such reciprocating pumps commonly consists of a ball and seat valve or a flapper valve. On the downstroke, the movement of the travelling valve assembly through the fluid and the incompressible nature of the liquid trapped between the traveling valve and the standing valve lifts the ball or the flapper from the valve seat thereby opening the valve. On the upstroke, the hydrostatic pressure of the fluid above the ball or the flapper, and the movement of the travelling valve assembly through the fluid forces the ball or flapper down onto the seat thereby closing the valve. Other types of valves employing similar actuating mechanisms on the up and downstrokes are employed, but in each instance, the consistent opening and closing of the traveling valve with the downstrokes and upstrokes of the plunger is essential to the efficient pumping of production fluid up the production tubing.

Although the reciprocating downhole pump described above is commonly used, there are circumstances that can render its use problematic and inefficient. For example, production fluids containing dissolved gases can result in an undesirable phenomenon known as "gas locking" if dissolved gases break out of solution. On the upstroke of the plunger, the gases flow upwards through the open standing valve into the pump barrel between the standing valve and the plunger. On the downstroke of the plunger, the plunger will compress the gases between the plunger and the closed standing valve. This is counterproductive to the effect of the production fluid in the pump barrel below the travelling valve forcing the valve member to its open position against the weight of the production fluid above the travelling valve. On the following upstroke, the compressed gas in the pump barrel between the traveling valve and the standing valve expands to fill the enlarged space. This prevents the upward flow of more production fluid from the production tubing through the standing valve and into the pump barrel. As such, the upstrokes and downstrokes of the pump simply result in the repeated compression and expansion of trapped gas between the standing valve and the traveling valve, and the pumping of fluid is prevented or decreased in efficiency. An associated problem is "fluid pounding" which occurs when the space in the pump barrel below the traveling valve is partially filled with fluid and partially with gas. The consequence of such a composition in the pump barrel is that the plunger forcefully enters the fluid level part way through the downstroke. This causes undesired vibrations, or "pounding", through the production string leading to mechanical failure and expedited wear.

Therefore, there is a need in the art for a tool that helps to ensure that a traveling valve assembly of a reciprocating downhole pump opens and closes as intended.

SUMMARY OF THE INVENTION

The present invention provides a downhole tool for opening a travelling valve assembly of a downhole pump, the tool and travelling valve assembly being disposed within a pump barrel, and the traveling valve comprising a valve member movable between an open position and a closed position. The tool comprises:

(a) a substantially cylindrical housing, wherein the housing comprises an outer surface and defines:
  (i) an axial bore extending from a bottom opening for fluid communication with the pump barrel;
  (ii) at least one radial port for fluid communication between the axial bore and the pump barrel;
  (iii) for each of the at least one radial port, a channel formed in the outer surface of the housing for fluid communication between the at least one radial port and the travelling valve assembly; and (b) a piston slidably disposed within the axial bore and occluding the axial bore above the at least one radial port, wherein the piston is responsive to an upward pressure exerted by a production fluid below the piston to slide upwardly within the axial bore from a retracted position to an extended position in which the piston engages the valve member to move the valve member to the open position.

In one embodiment of the tool, the housing comprises a threaded connection for removable attachment to a complementary threaded connection of the travelling valve assembly.

In one embodiment of the tool, either the housing comprises a lower segment and an upper segment removably attachable to the lower segment, wherein the piston is removable from the housing when the upper segment is detached from the lower segment.

In one embodiment of the tool, the at least one radial port comprises a plurality of radial ports circumferentially spaced apart on the housing.

In one embodiment of the tool, the channel tapers inwardly towards the at least one radial port.

In one embodiment of the tool, the housing defines a pair of internal shoulders that engage the piston to limit sliding of the piston between the retracted position and the extended position.

In one embodiment of the tool, the piston comprises a cylindrical rod and an intermediate section attached to rod between the lower end of the rod and a top end of the rod, wherein the intermediate section engages an internal shoulder of the housing to occlude the axial bore above the at least one radial port.

In one embodiment of the tool, the piston comprises a cylindrical rod and a base attached to a lower end of the rod, wherein the base engages an internal shoulder of the housing to occlude the axial bore above the at least one radial port.

In one embodiment of the tool, the piston comprises a concave bottom surface.

In one embodiment of the tool, the valve member is a ball, and the piston comprises a concave top surface adapted to engage the ball.

In one embodiment of the tool, the tool further comprises a seal for sealing the outer surface to the pump barrel below the at least one radial port. The seal may comprise a sealing ring disposed circumferentially around the housing.

In one embodiment of the tool, the channel extends from the at least one radial port to an upper end of the housing.

In one embodiment of the tool:

(a) the axial bore extends from the bottom opening to a top opening for fluid communication with the travelling valve assembly;

(b) the at least one radial port comprises a lower radial port and an upper radial port; and (c) the piston occludes the axial bore above the lower radial port and below the upper radial port.

The tool may further comprise a lower seal for sealing the outer surface to the pump barrel below the lower radial port, and an upper seal for sealing the outer surface to the pump barrel above the upper radial port. Each of the lower seal and the upper seal may comprise a sealing ring disposed circumferentially around the housing. The outer surface of the housing may define a lower circumferential groove for retaining the sealing ring of the lower seal, and an upper circumferential groove for retaining the sealing ring of the upper seal. The sealing ring may taper radially outwards from a top end to a bottom end.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for a downhole tool for opening a travelling valve assembly of a reciprocating downhole pump. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
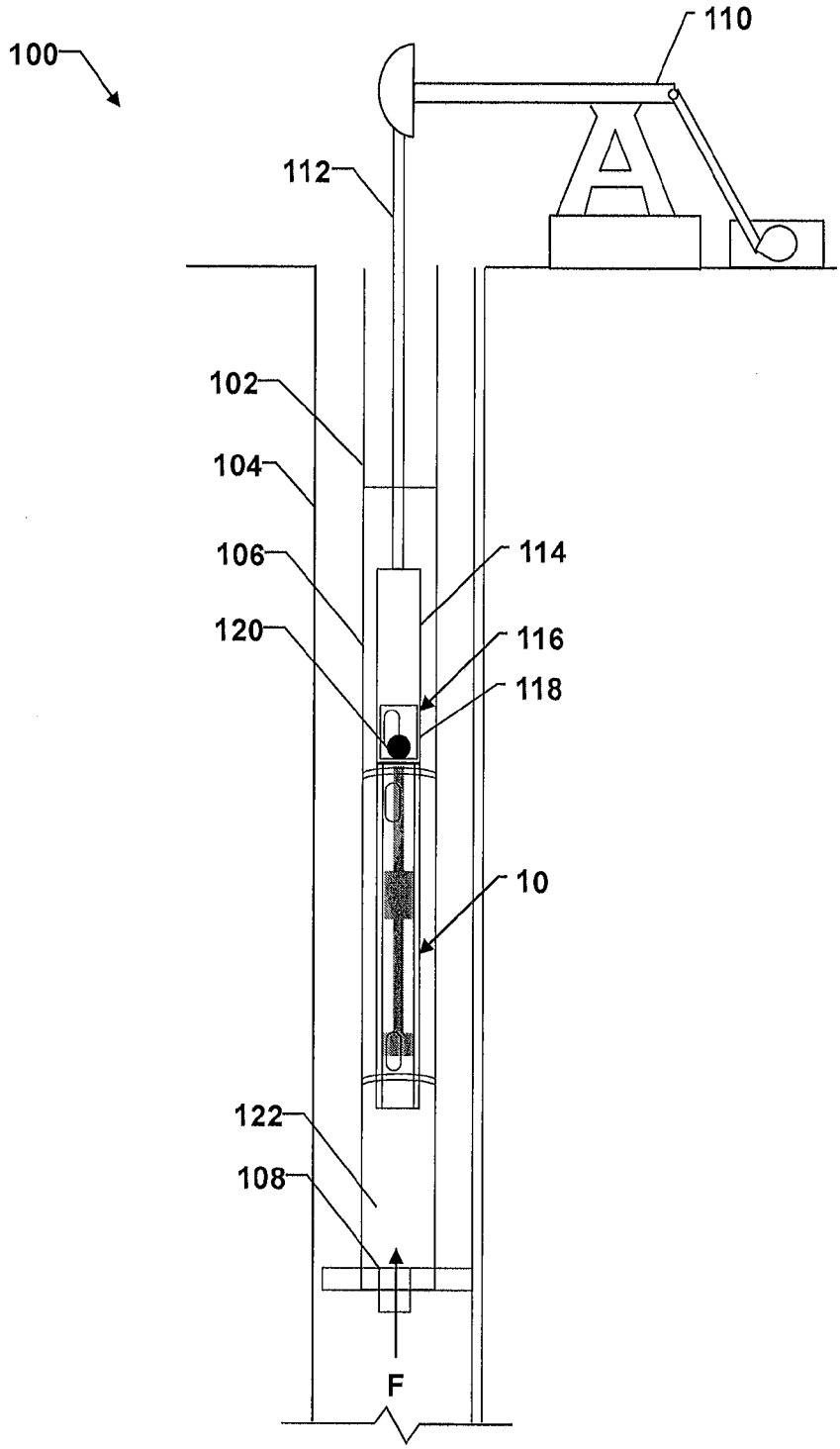
FIG. 1 is a sectional schematic view of a reciprocating downhole pump incorporating one embodiment of the tool of present invention.

To facilitate description of the tool of the present invention, FIG. 1 shows an embodiment of a reciprocating downhole pump 100 incorporating one embodiment of the tool 10. The reciprocating downhole pump 100 includes production tubing 102 positioned inside the casing 104 of a well bore. The production tubing 102 is continuous with a cylindrical pump barrel 106 that is positioned above a standing valve 108. A reciprocating motor 110 is attached to a sucker rod 112, which is in turn attached to the top end of a travelling plunger 114. The reciprocating motor 110 moves the plunger 114 axially up and down the pump barrel 106. A travelling valve assembly 116 inside the plunger 114 has a valve 118 that allows production fluid F to flow into the pump barrel 106. The valve 118 has a valve cage containing a ball 120 that alternately seats on and unseats from a valve seat to close and open the valve 118. In other embodiments, not shown, the valve 118 may be a flapper valve. The tool 10 of the present invention is attached to the travelling valve assembly 116 and is disposed within the pump barrel 106. The described embodiment of the reciprocating downhole pump 100, its travelling valve assembly 116 and downhole configuration is only illustrative and not limiting of the present invention.

Figure 2:
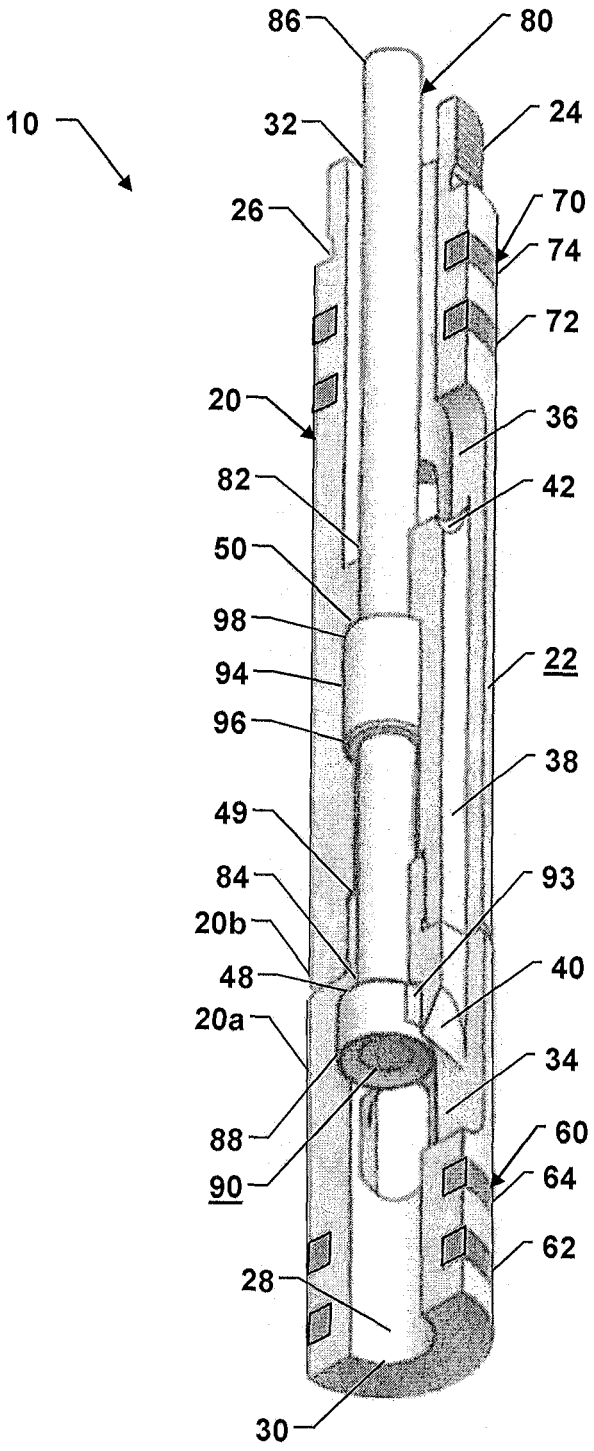
FIG. 2 is a cut-away sectional perspective view of one embodiment of the assembled tool of the present invention.

FIGS. 2-6 show one embodiment of the tool 10 of the present invention. Any dimensions of the parts of the embodiment of the tool 10 as shown in these Figures are provided only for illustrative purposes and are not limiting of the present invention. The tool 10 may be constructed in varying sizes for use with differing downhole environments, pump barrel sizes and types of traveling valve assemblies to meet the requirements of a particular application. Referring to FIG. 2, the tool 10 generally includes a housing 20, a lower seal 60, an upper seal 70, and a piston 80.

The housing 20 may be made of any material that is sufficiently hard and durable to withstand wear in a downhole environment. In one embodiment, the housing 20 is made of stainless steel to minimize corrosion and wear.

The housing 20 has a substantially cylindrical shape. As used herein, the terms "axial" and "radial" in relation to the parts of the tool 10 refer to the directions substantially parallel with and substantially perpendicular, respectively, to the longitudinal axis of the housing 20. When the tool 10 is in a vertical orientation, the "axial" direction coincides with the vertical direction and the "radial" direction coincides with the horizontal direction.

The outer diameter of the housing 20 is selected to be smaller than the inner diameter of the pump barrel 106 so that the housing 20 can slide axially within the pump barrel 106. At the same time, the outer diameter of the housing 20 may be selected to be within a close tolerance of the inner diameter of the pump barrel 106 to minimize the annular space between the outer surface 22 of the housing 20 and the inner wall of the pump barrel 106.

The housing 20 attaches to the travelling valve assembly 116 using any suitable means known in the art. The attachment may be either direct or indirect, and either removable or permanent. In one embodiment as shown in FIGS. 2-5, the upper end of the housing 20 has a male threaded connection 24 for a direct and removable connection to a corresponding female threaded connection formed on the travelling valve assembly 116. The housing 20 also has a neck profile 26 to facilitate removal of the travelling valve assembly 116 from the tool 10.

The housing 20 defines an axial bore 28 that concentrically receives the piston 80 and allows the piston 80 to slide axially therein. The axial bore 28 extends from a bottom opening 30 to a top opening 32 of the housing 20. The bottom opening 30 allows the production fluid F in the pump barrel 106 below the tool 10 to flow into the axial bore 28. In one embodiment as shown in FIG. 2, the top opening 32 allows the production fluid F in the axial bore 28 to flow into the travelling valve assembly 116 when attached to the upper end of the tool 10, and the piston 80 to pass through.

The housing 20 defines at least one pair of vertically separated radial ports 34, 36 to allow the production fluid F to flow between the axial bore 28 and the pump barrel 106. In one embodiment as shown in FIGS. 2-5, the housing 20 defines three pairs of radial ports 34, 36, equally circumferentially spaced apart from each other on the housing 20. Each pair of radial ports 34, 36 is associated with a channel 38 formed in the outer surface 22 of the housing 20. The channel 38 allows the production fluid F to flow externally of the housing 20, but internally of the pump barrel 106, from the lower radial port 30 to the upper radial port 32. In one embodiment as shown in FIGS. 2-5, the part of the outer surface 22 defining the lower end 40 and the upper end 42 of the channel 38 taper radially inwardly towards the axial bore 28 to encourage a smooth flow of the production fluid F through the radial ports 34, 36. The channels 38 may be configured so that the cross-sectional area of the spaces defined between the channels 38 and the inner wall of the pump barrel 106 (the external area) relative to the cross-sectional area of the axial bore 28 immediately below the lower radial port 34 (the internal area) avoids undue flow restriction of the production fluid F, while still maintaining the pressure of production fluid F as it flows from the internal area to the external area. In embodiments, for example, the external area may be less than or equal to the internal area.

The lower seal 60 and the upper seal 70 provide a fluid-tight seal between the outer surface 22 of the housing 20 and the inner wall of the pump barrel 106. The lower seal 60 is positioned below the pair of radial ports 34, 36 while the upper seal 70 is positioned above the pair of radial ports 34, 36. The seals 60, 70 may be made of any suitable material known in the art that is sufficiently, pliable, resilient and durable to withstand wear and friction with the inner wall of the pump barrel 106. In one embodiment, the seals 60, 70 are made of an elastomeric rubber.

Figure 3:
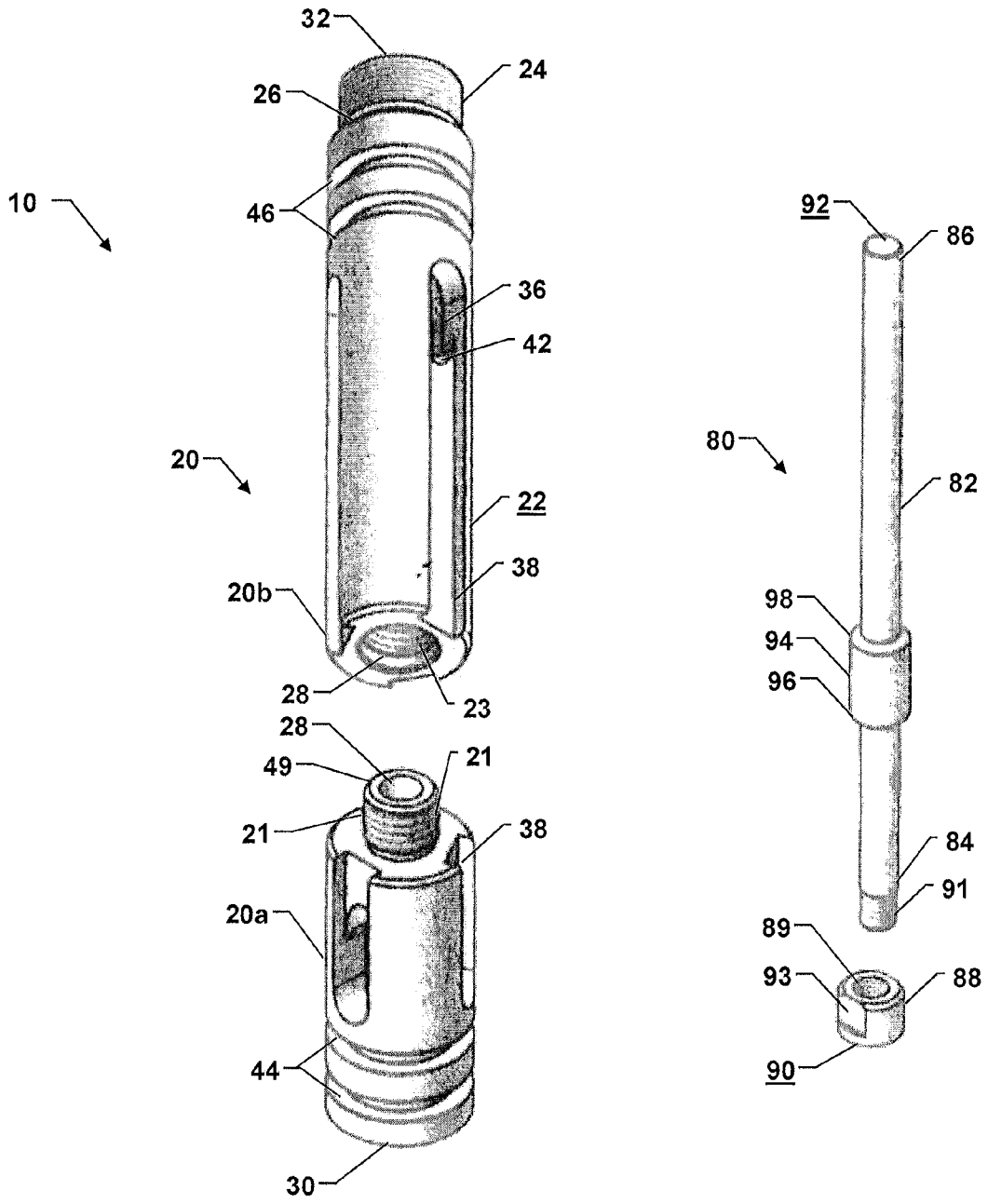
FIG. 3 is a perspective view of the embodiment of the tool as shown in FIG. 2, when disassembled and without the lower seal and upper seal.
Figure 4:
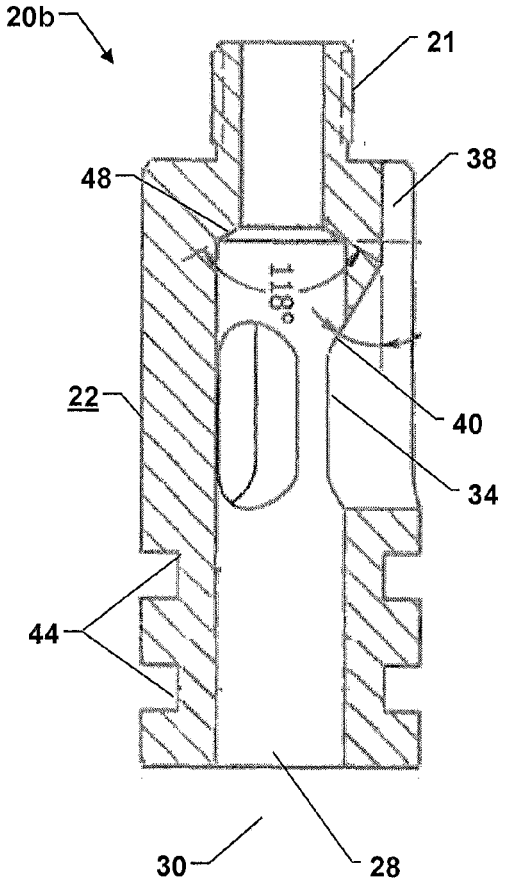
FIG. 4 is a half-sectional elevation view of the lower segment of the housing of the embodiment of the tool shown in FIG. 2.
Figure 5:
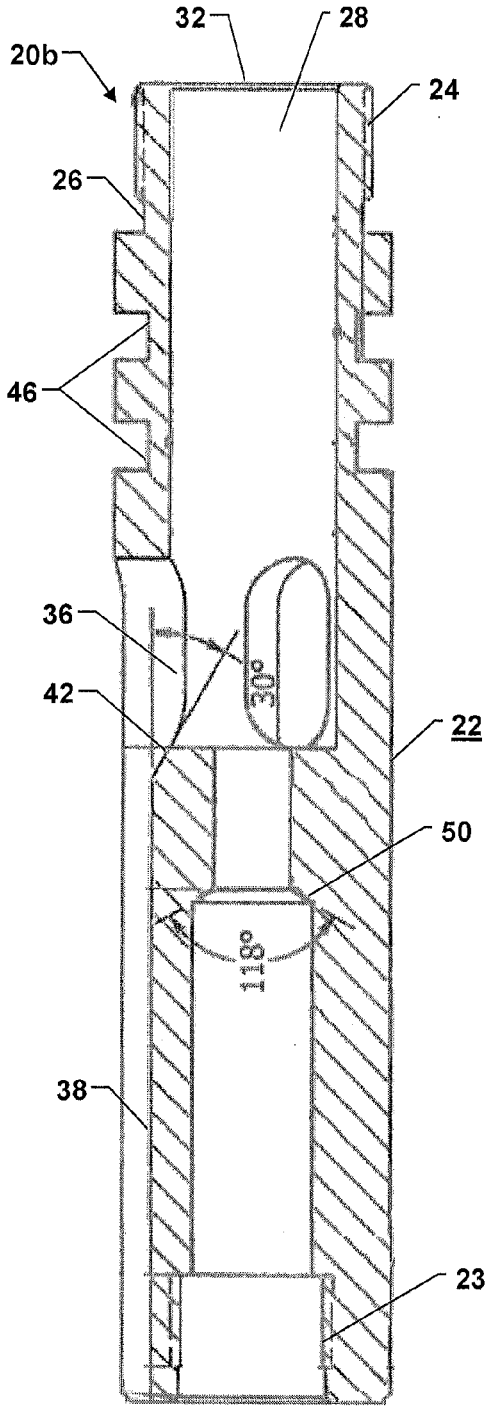
FIG. 5 is a half-sectional elevation view of the upper segment of the housing of the embodiment of the tool shown in FIG. 2.

In one embodiment as shown in FIG. 2, the lower seal 60 is provided by a pair of sealing rings 62, 64 and the upper seal 70 is provided by a pair of sealing rings 72, 74. In one embodiment as shown in FIG. 3, the lower sealing rings 62, 64 are retained by a pair of lower circumferential grooves 44 formed in the outer surface 22 of the housing 20, while the upper sealing rings 72, 74 are retained by upper circumferential grooves 46 formed in the outer surface 22. In one embodiment, the sealing rings 62, 64, 72, 74 have a tapered profile, being wider at the bottom than at the top, so that the combined effect of friction between the sealing rings 62, 64, 72, 74 and the inner wall of the pump barrel 106 and the upward pressure of the production fluid F acting on the bottom face of the sealing rings 62, 64, 72, 74 causes them to expand radially against the inner wall of the pump barrel 106 as the housing 20 slides axially downwards in the pump barrel 106.

The piston 80 slides axially within the axial bore 28 to move the valve member 120 from the closed position to the open position. The piston 80 may be made of any suitable material known in the art that is sufficiently hard and durable to withstand wear in a downhole environment. In one embodiment, the piston 80 is made of stainless steel to minimize corrosion and wear.

Figure 6:
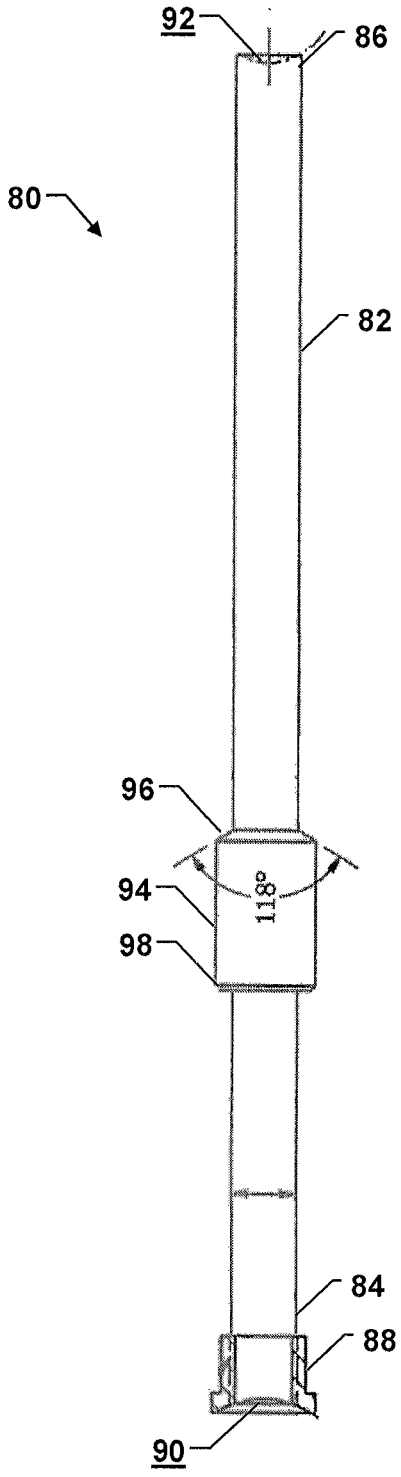
FIG. 6 is an elevation view of the piston of the embodiment of the tool shown in FIG. 2, with the base shown in half-section.

In one embodiment as shown in FIGS. 2, 3 and 6, the piston 80 comprises an elongate cylindrical rod 82 extending from a bottom end 84 to a top end 86. In one embodiment, the top end 86 of the piston 80 has a concave top surface 92 adapted to engage a valve member in the form of ball 120. In other embodiments, the top surface 92 of the piston 80 may have a different shape.

The piston 80 further comprises a cylindrical base 88 with an enlarged diameter relative to the rod 82 to maximize the surface area of the piston 80 that is acted upon by the production fluid F below the tool 10. The chamfered upper end of the base 88 is adapted to engage a complementary chamfered upper internal shoulder 48 of the housing 20 to occlude the axial bore 28 between the pair of radial ports 34, 36. Further, the base 88 has a concave bottom surface 90, which helps to redirect upward flowing production fluid F back towards the lower radial port 34.

The piston 80 further comprises a cylindrical intermediate section 94 with an enlarged diameter relative to the rod 82. The intermediate section 94 has a lower end 96 adapted to engage a lower internal shoulder 49 of the housing 20, and a chamfered upper end 98 adapted to engage a complementary chamfered upper internal shoulder 50 of the housing 20. When the upper end 98 of the intermediate section 94 engages the upper internal shoulder 50 of the housing 20, the intermediate section 94 occludes the axial bore 28 between the pair of radial ports 34, 36.

Each of the housing 20 or the piston 80 or both of them, may be made of several components to facilitate assembly, disassembly, and servicing of the tool 10. In one embodiment as shown in FIG. 3, the housing 20 is made of a lower segment **20*a* and an upper segment 20*b*. The upper end of the lower segment 20*a* has a male threaded connection 21 that is received by a corresponding female threaded connection 23 at the lower end of the upper segment 20*b*. Further, the base 88 of the piston 80 has a female threaded connection 89 that receives a male threaded connection 91 formed on the bottom end 84 of rod 82 of piston 80. The base 88 is also provided with wrench flats 93 to facilitate assembly and disassembly of the rod 82 and base 88**.

The use and operation of the embodiment of the tool 10 as shown in the Figures FIGS. 2-6 is now described. To assemble the tool 10 as shown in FIG. 2, the lower end 84 of the rod 82 is inserted downwardly into the axial bore 28 of the lower segment 20*a* of the housing 20, while the upper end 86 of the rod 82 is inserted upwardly into the axial bore 28 of the upper segment 20*b* of the housing 20. The lower segment 20*b* and the upper segment 20*b* are then screwed together by their corresponding threaded connections 21, 23, thus retaining the intermediate section 94 of the piston 80 between the lower internal shoulder 49 and upper internal shoulder 50 of the housing 20. The base 88 and the rod 82 are screwed together by their corresponding threaded connections 89, 91. The housing 20 and travelling valve assembly 116 are screwed together using threaded connection 24. The travelling valve assembly 116, being part of the plunger 114, is then lowered into the pump barrel 106 of the reciprocating pump 100, as shown in FIG. 1.

Figure 7:
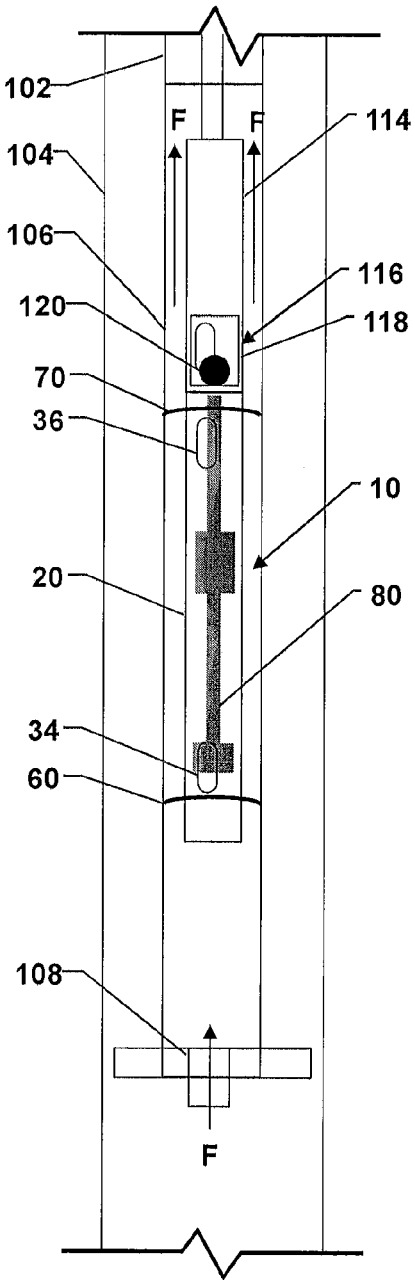
FIG. 7 is a sectional schematic view of a reciprocating downhole pump incorporating one embodiment of the tool of present, during the upstroke of the pump.

In operation, the pump 100 reciprocates axially, alternately between an upstroke and a downstroke, moving the tool 10 up and down within the pump barrel 106. During the upstroke of the pump 100, as shown in FIG. 7, the weight of the piston 80 and the upward movement of the housing 20 causes the piston 80 to slide downwardly within the axial bore 28, until the intermediate section 94 of the piston 80 engages the lower internal shoulder 49 of the housing 20. In this retracted position, the upper end 86 of the piston 80 allows the ball 120 to come to rest on the valve seat. The pressure of the production fluid F above the ball 120 forces the ball 120 onto the valve seat, thus closing the valve 118 of travelling valve assembly 116. As the plunger 114 continues to move upwardly within the pump barrel 106, the plunger 114 lifts a column of the production fluid F in the portion of the pump barrel 106 above the tool 10, as shown by the arrow lines, towards the surface. At the same time, the upward movement of the plunger 114 draws additional production fluid F through the open standing valve 108 into the portion of the pump barrel 106 below the tool 10.

Figure 8:
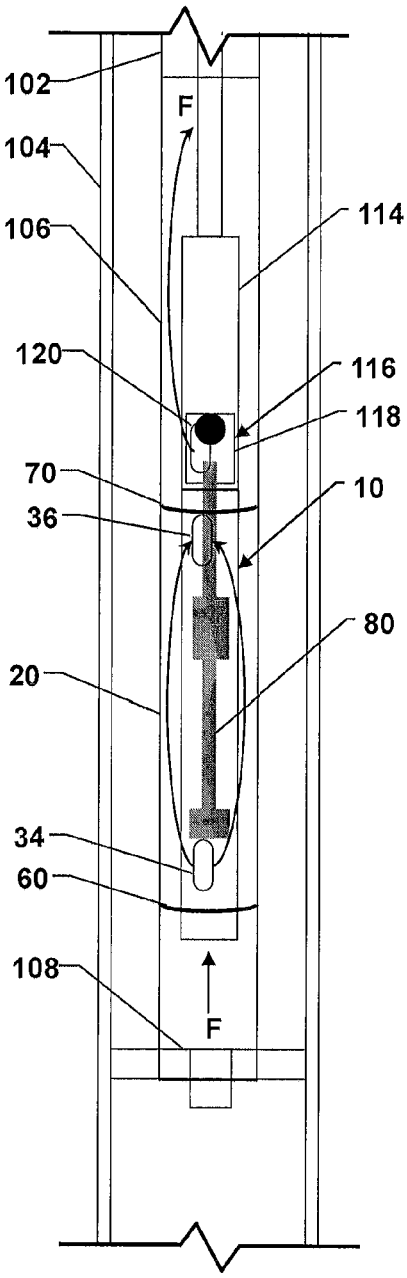
FIG. 8 is a sectional schematic view of a reciprocating downhole pump incorporating one embodiment of the tool of present, during the downstroke of the pump.

During the downstroke of the pump 100, as shown in FIG. 8, the lower seal 60 wipes downwardly against the inner wall of the pump barrel 106, preventing any fluid to pass between the housing and the pump barrel 106. This forces the production fluid F towards the standing valve 108. However, as the standing valve 108 is now closed, the production fluid F in the portion of the pump barrel 106 below the tool 10 is forced to flow through the bottom opening 30 of the housing 20 and into the axial bore 28 below the piston 80. This increases the pressure of the production fluid F acting on the bottom surface 90 of the base 88 of the piston 80. Accordingly, the production fluid F urges the piston 80 to slide upwardly within the axial bore 28, until the intermediate section 94 of the piston 80 engages the upper internal shoulder 50 of the housing 20. In this extended position, the concave top surface 92 of the piston 80 pushes the ball 120 off of the valve seat, thus opening the valve 118 of travelling valve assembly 116 and prevents the ball 120 from returning to the valve seat.

In the extended position, the base 88 and intermediate section 94 of the piston 80 occlude the axial bore 28 between the radial ports 34, 36. Therefore, as shown by the arrow lines, the production fluid F in the axial bore 28 below the piston 80 flows through the lower radial port 34 and into the interior of the pump barrel 106. In the pump barrel 106, the combined effect of the seals 60, 70 and the close tolerance of the outer surface 22 of the housing 20 and the inner wall of the pump barrel 106, causes the production fluid F to flow in the channel 38, through upper radial port 36 and back into the axial bore 28 above the intermediate section 94 of the piston 80. The production fluid F continues to flow upwards in the axial bore 28, through the top opening 32 and into the travelling valve assembly 116. In the travelling valve assembly 116, the production fluid flows through the open valve 118 and the valve cage, thus charging the portion of the pump barrel 106 above the tool 10 with production fluid F, which is lifted by the subsequent upstroke of the pump 100.

Figure 9:
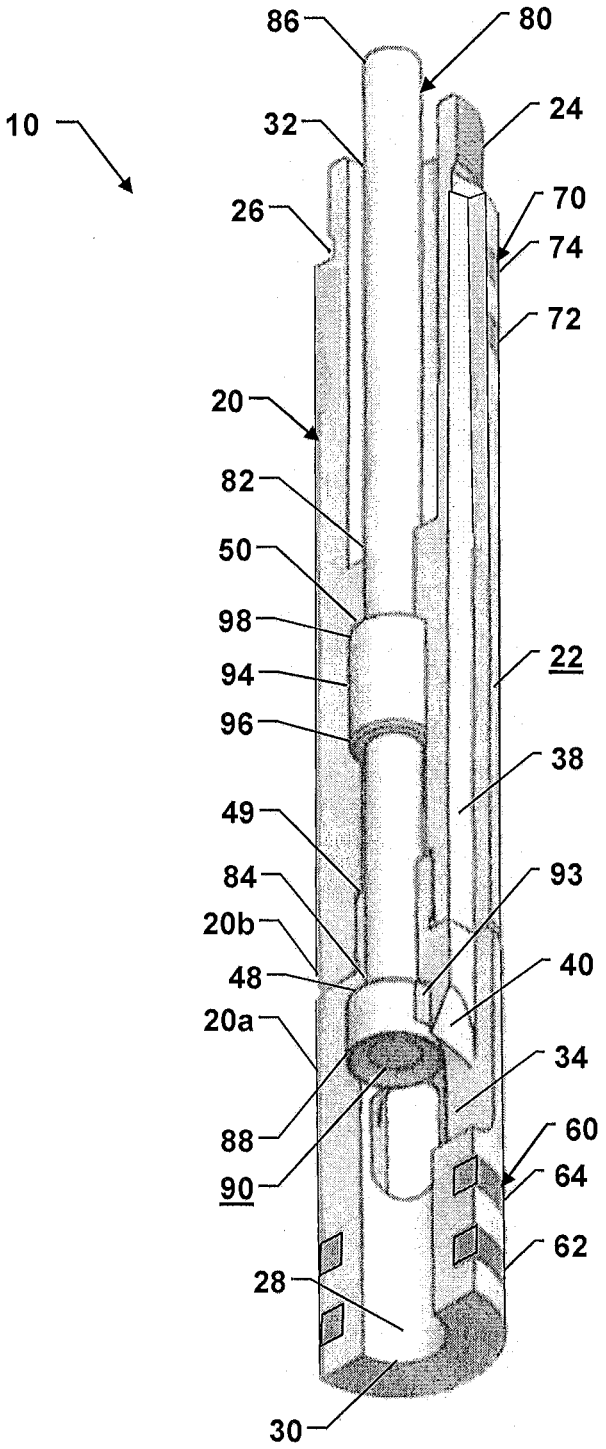
FIG. 9 is a cut-away sectional perspective view of another embodiment of the assembled tool of the present invention.

FIG. 9 shows an alternative embodiment of the tool 10 of the present invention. This embodiment of the tool 10 differs from the embodiment of the tool 10 shown in FIG. 2, in that the tool 10 does not have upper radial ports 36, and that the channels 38 extend upwardly from the radial ports 34 to an upper end of the housing 20. The use and operation of this embodiment of the tool 10 is the same as that of the embodiment of the tool 10 shown in FIG. 2, except that the production fluid F flows from the channels 38 to the travelling valve assembly 116 in an alternative fluid passageway, rather than through the top opening 32 of the tool 10. As will be apparent to those skilled in the art, various modifications, adaptations and variations of the foregoing specific disclosure can be made without departing from the scope of the invention claimed herein.

What is claimed is:

1. A downhole tool for opening a travelling valve assembly of a downhole pump, the tool and travelling valve assembly being disposed within a pump barrel, and the travelling valve comprising a valve member in a travelling valve housing, the valve member movable between an open position and a closed position, the tool comprising:

(a) a substantially cylindrical housing, wherein the housing comprises an outer surface and defines:

(i) an axial bore extending from a bottom opening for fluid communication with the pump barrel;

(ii) at least one radial port for fluid communication between the axial bore and the pump barrel;

(iii) for each of the at least one radial port, a channel formed in the outer surface of the housing for fluid communication between the at least one radial port and the travelling valve assembly; and (b) a piston slidably disposed within the axial bore and occluding the axial bore above the at least one radial port, wherein the piston is responsive to an upward pressure exerted by a production fluid below the piston to slide upwardly within the axial bore from a retracted position to an extended position in which the piston engages the valve member in the travelling valve housing to move the valve member to the open position.

2. The tool of claim 1 wherein the housing comprises a threaded connection for removable attachment to a complementary threaded connection of the travelling valve assembly.

3. The tool of claim 1 wherein either the housing comprises a lower segment and an upper segment removably attachable to the lower segment, wherein the piston is removable from the housing when the upper segment is detached from the lower segment.

4. The tool of claim 1 wherein the at least one radial port comprises a plurality of radial ports circumferentially spaced apart on the housing.

5. The tool of claim 1 wherein the channel tapers inwardly towards the at least one radial port.

6. The tool of claim 1 wherein the housing defines a pair of internal shoulders that engage the piston to limit sliding of the piston between the retracted position and the extended position.

7. The tool of claim 1 wherein the piston comprises a cylindrical rod and an intermediate section attached to rod between the lower end of the rod and a top end of the rod, wherein the intermediate section engages an internal shoulder of the housing to occlude the axial bore above the at least one radial port.

8. The tool of claim 1 wherein the piston comprises a cylindrical rod and a base attached to a lower end of the rod, wherein the base engages an internal shoulder of the housing to occlude the axial bore above the at least one radial port.

9. The tool of claim 1 wherein the piston comprises a concave bottom surface.

10. The tool of claim 1 wherein the valve member is a ball, and the piston comprises a concave top surface adapted to engage the ball.

11. The tool of claim 1 further comprising a seal for sealing the outer surface to the pump barrel below the at least one radial port.

12. The tool of claim 11 wherein each of the seal comprises a sealing ring disposed circumferentially around the housing.

13. The tool of claim 12 wherein the outer surface of the housing defines a circumferential groove for retaining the sealing ring.

14. The tool of claim 13 wherein the sealing ring tapers radially outwards from a top end to a bottom end.

15. The tool of claim 1 wherein the channel extends from the at least one radial port to an upper end of the housing.

16. The tool of claim 1 wherein:

(a) the axial bore extends from the bottom opening to a top opening for fluid communication with the travelling valve assembly;

(b) the at least one radial port comprises a lower radial port and an upper radial port; and (c) the piston occludes the axial bore above the lower radial port and below the upper radial port.

17. The tool of claim 16 further comprising a lower seal for sealing the outer surface to the pump barrel below the lower radial port, and an upper seal for sealing the outer surface to the pump barrel above the upper radial port.

18. The tool of claim 16 wherein each of the lower seal and the upper seal comprises a sealing ring disposed circumferentially around the housing.

19. The tool of claim 18 wherein the outer surface of the housing defines a lower circumferential groove for retaining the sealing ring of the lower seal, and an upper circumferential groove for retaining the sealing ring of the upper seal.

20. The tool of claim 18 wherein the sealing rings taper radially outwards from a top end to a bottom end.

* * * * *